US005498103A

United States Patent [19]

Bauer, III

[11] Patent Number: 5,498,103

[45] Date of Patent: Mar. 12, 1996

[54] APPLICATOR APPARATUS FOR DISPENSING A SEALANT

[76] Inventor: Andrew J. Bauer, III, 5501 Decker Rd., Louisville, Ky. 40258

[21] Appl. No.: 199,058

[22] Filed: Feb. 22, 1994

[51] Int. Cl.[6] ..... E01C 23/02

[52] U.S. Cl. ..... 404/107

[58] Field of Search ..... 404/107, 108, 404/111, 101; 141/311 R

[56] References Cited

U.S. PATENT DOCUMENTS 4,695,185 9/1987 Spells et al. ..... 404/107

*Primary Examiner*—Michael Powell Buiz
*Attorney, Agent, or Firm*—Middleton & Reutlinger; Charles G. Lamb

[57] ABSTRACT

An applicator apparatus for dispensing and shaping a sealant material into a groove to be filled with the sealant material includes a dispensing head having an arcuate convex bottom surface which rides on the opposite side edges of the groove to be filled and protrudes into the groove and functions to shape or form a corresponding arcuate shape in the top side of the sealant. The dispensing head further includes a sealant dispensing passage having a sealant outlet opening at the bottom surface for dispensing sealant into the groove. In operation, the dispensing head is moved along the groove to be filled with sealant material, and concurrently sealant material is dispensed through the dispensing passage into the groove. As the dispensing head is moved along the groove, the arcuate bottom surface of the dispensing head forms a corresponding shape into the dispensed sealant material in the groove.

9 Claims, 3 Drawing Sheets

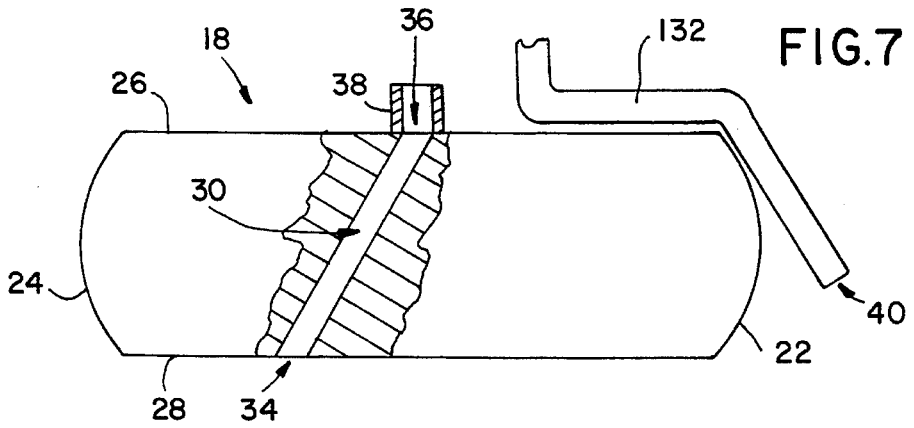
FIG.7
FIG.8
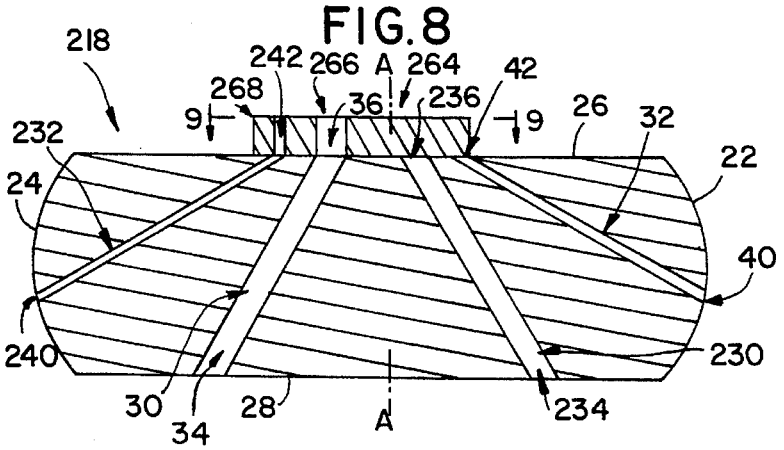
FIG.9
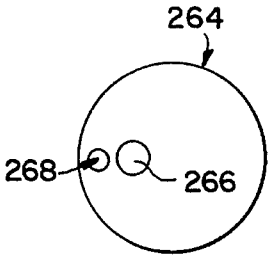
FIG.10
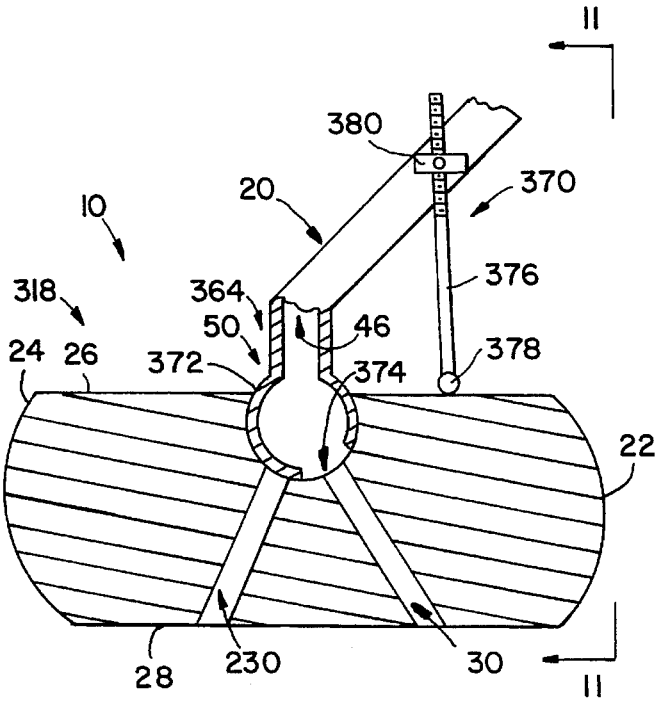
FIG.11
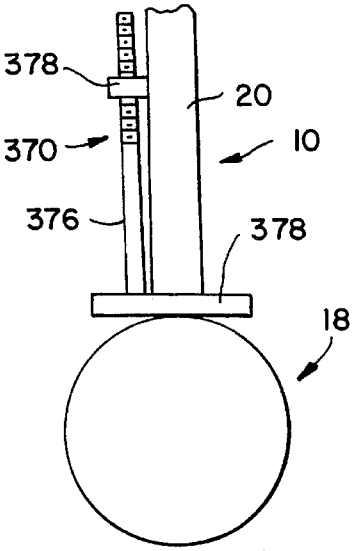

APPLICATOR APPARATUS FOR DISPENSING A SEALANT

BACKGROUND OF THE INVENTION

The present invention relates to applicator apparatus for dispensing a flowable material, and more particularly to an applicator apparatus for dispensing a flowable sealant material into a groove which applicator apparatus forms a smooth surface into the dispensed sealant in the groove concurrently with the dispensing function so that a finished seal is formed in the groove by a single pass of the applicator apparatus along the length of the groove to be sealed.

It is common practice to fill the groove or joint between adjacent structures to prevent the ingress of moisture into the joint. In a specific application, for example, concrete roadways or airport runways typically are formed in sections (either by pouring the sections separately or cutting grooves therein to form sections) to allow for the expansion and contraction of the concrete. These joints or grooves must be sealed to prevent the passage of moisture through the grooves into the supporting substrate. It is further desirable inorder to prevent damage to the seal that the sealant be recessed below the top surfaces of the adjacent concrete sections so that the wheels of vehicles passing over the sealed grooves will not contact the sealant material.

U.S. Pat. No. 4,695,185 issued on Sep. 22, 1987 to Dow Corning Corporation discloses an example of one type of heretofore known sealant dispensing apparatus which is used to dispense a sealant into a groove and form a concave surface in the sealant so that the sealant is recessed below the top surfaces of the adjacent sections to either side of the groove. The sealant dispensing apparatus is shown as having a spherical dispensing head or applicator with a diametrically extending hole or sealant passage formed therethrough. An elongated hollow arm is rigidly attached to the spherical applicator with the hollow interior of the arm is open to the sealant passage through the applicator for routing sealant to the sealant passage. In use the spherical applicator so that is rests on the corners of the groove and extends downwardly a short distance into the groove. The dispensing apparatus is held in the hands of a workman with the arm, and therefore the sealant passage maintained at a slant to the surfaces to the adjacent sections to either side of the groove to be sealed and the applicator is moved along the groove maintaining the slant of the arm and applicator. It is a difficult task to maintain the proper slant of the applicator (and therefore the sealant passage) as the applicator is moved along the groove, and it is not uncommon for the slant to change thereby resulting a non-uniform dispensing of the sealant into the groove.

Further, it is desirable to clean the groove of debris, such as dust and dirt particles before the sealant material is dispensed into the groove so that the seal is not contaminated with such material which could result in a low quality seal. It is common practice to sweep the grooves with a broom or compressed air prior to and as a separate operation from the operation of dispensing sealant into the groove.

The present invention recognizes the drawbacks of the prior art sealant applicators and provides a practical solution thereto.

Further, the present invention solves the problems of the heretofore known methods of having to clean the grooves as a separate operation or task from the dispensing of the sealant into the grooves.

BRIEF SUMMARY OF THE INVENTION

The present invention provides, in one embodiments an applicator apparatus for dispensing and shaping a sealant material into a groove to be filled with the sealant material comprising a dispensing head having a front end, a back end, a top side, and a convex bottom surface for shaping the sealant material deposited in the groove as the dispensing head is moved along the length of the groove. The dispensing head has an elongated shape wherein the length of the dispensing head is substantially greater than the width of the convex bottom surfaces and the convex bottom surface having width dimension greater than the width of the groove so that when in use the dispensing head remains in contact with the opposite side edges of the groove and so that a portion of the convex surface protrudes into the groove for shaping the upper surface of the sealant material deposited in the groove. A sealant dispensing passage is formed through the dispensing head with a sealant outlet opening at the bottom surface of the dispensing head between the front end and back end of the dispensing head, the sealant dispensing passage being slanted in a direction general from the front end toward the back end of the dispensing head.

The present invention further provides in another embodiment, an applicator apparatus for dispensing and shaping a sealant material into a groove to be filled with the sealant material, comprising a dispensing head having a convex bottom surface for shaping the top surface of the sealant material deposited in the groove, and the convex bottom surface having a width dimension greater than the width to the grooves so that when in use the dispensing head remains in contact with the opposite side edges of the groove and so that a portion of the convex surface protrudes into the groove for shaping the upper surface of the sealant material deposited in the groove. A sealant dispensing passage is formed through the dispensing head with a sealant outlet opening at the bottom surface of the dispensing head, and an air passage having an air outlet opening at the front end of the dispensing head.

BRIEF DESCRIPTION OF THE DRAWINGS

A better understanding of the present invention will be had upon reference to the following description in conjunction with the accompanying drawings wherein:

FIG. 7 is an enlarged cross-sectional side view of another embodiment of a sealant dispensing head of the sealant applicator apparatus of the present invention;

FIG. 8 is an enlarged cross-sectional side view of yet another embodiment of a sealant dispensing head of the sealant applicator apparatus of the present invention;

FIG. 9 is a cross-sectional view of a portion of the sealant dispensing head of FIG. 8 as seen in the direction of arrows 9—9 in FIG. 8;

FIG. 10 is a side view of a sealant dispensing head of the present invention illustrating a stop device used therewith;

FIG. 11 is a view of the sealant dispensing head of FIG. 10 as seen in the direction of arrows 11—11 in FIG. 10; and, FIG. 12 is a cross-sectional side view of a further emodiment of a sealant dispensing head of the present invention.

DETAILED DESCRIPTION OF THE PREFERRED EMBODIMENT

Figure 1:
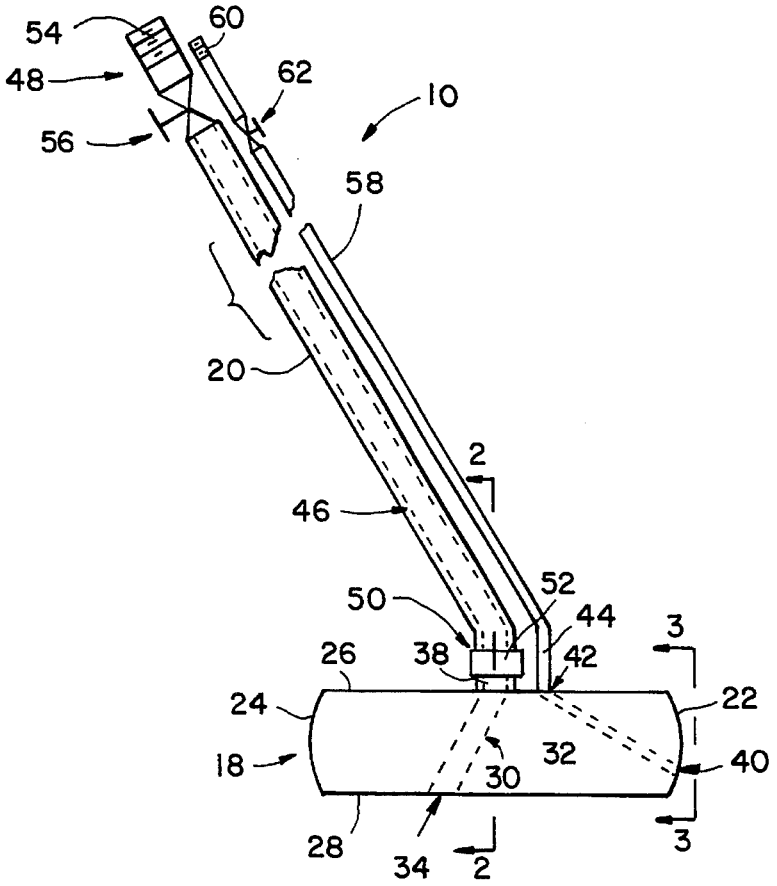
FIG. 1 is a side view of a sealant applicator apparatus of the present invention.

With reference to FIG. 1, there is shown a preferred embodiment of a applicator apparatus, generally denoted as the numeral 10, for dispensing shaping a sealant material 12 in a groove 14 between, for example, two adjacent sections of concrete 16.

The applicator apparatus 10 is shown as comprising a sealant dispensing head 18 and an elongated handle 20 attached to the sealant dispensing head 18. A workman grasping the handle 20 can easily manipulate the applicator apparatus 10 and move it along the groove 14 to be filled with sealant material 12.

Figure 5:
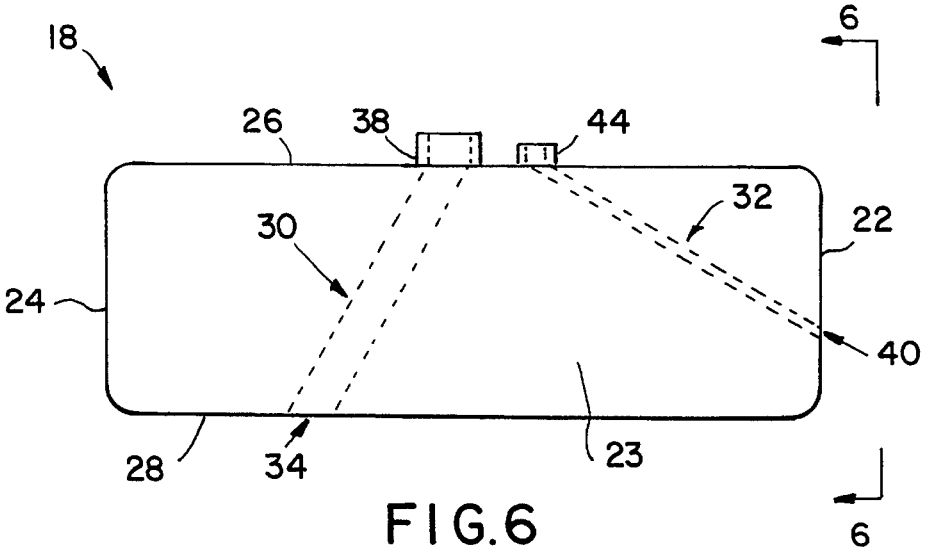
FIG. 5 is a side view of a sealant applicator apparatus illustrating an alternative embodiment of the dispensing head.
Figure 6:
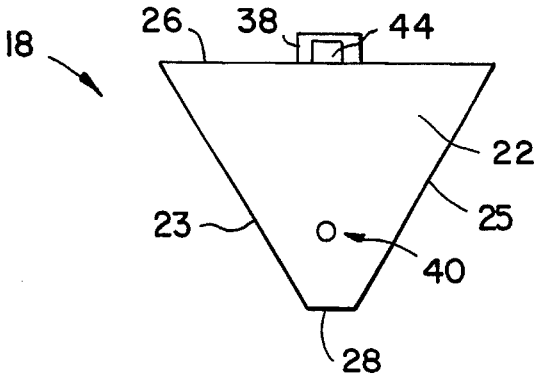
FIG. 6 is a front view of the sealant head of FIG. 5 as seen in the direction of arrows 6—6 in FIG. 5.

With reference to FIGS. 1–4 the sealant dispensing head 18 has a front end 22, a back end 24, a top side 26 and a bottom surface 28 shown as being arcuately conves in shape. The dispensing head 18 has an elongated shape wherein the length of the dispensing head 18 from the front end 22 to the back end 24 is substantially greater that the width of the bottom surface 28. It has been determined that a dispensing head 18 of a cylindrical configuration works well and is readily easy to manufactured however other configurations would also work well such as for example spherical. Also, it is not particularly necessary that the top side 26 be arcuate as it is in a cylindrical or spherical configuration, but it may also be, for example, flat. The shape of the top side 26 is not critical. The important feature is that at least a portion of the bottom surface 28 be small enough in the width dimension to fit into the groove 14 between adjacent sections of concrete 16. A bottom surface 28 of a convex, and preferably arcuate shape works well is this respect. With reference to FIGS. 5 and 6, there is shown an alternative configuration for the dispensing head 18 having side walls 23 and 25 which extend downwardly from the top side 26 converging toward the narrow bottom surface 28. The bottom surface 28 is of a predetermined width dimension small enough to fit or be received into the grove 14 between adjacent sections of concrete and the side walls 23 and 25 make contact with the opposite side edges of the groove 14.

Figure 2:
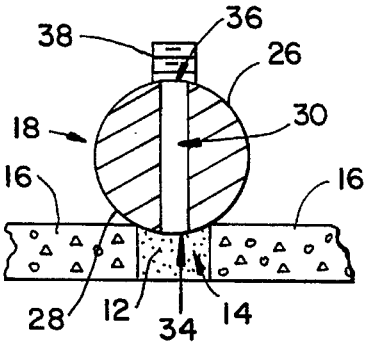
FIG. 2 is an enlarged cross-sectional view of the sealant dispensing head of the sealant applicator apparatus of FIG. 1 as seen in the direction of arrows 2—2 in FIG. 1.
Figure 3:
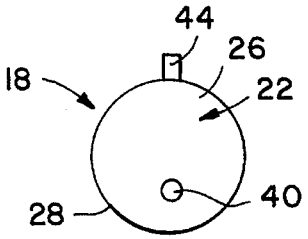
FIG. 3 is an enlarged front view of the sealant dispensing head of the sealant applicator apparatus of FIG. 1 as seen in the direction of arrows 3—3 in FIG. 1.
Figure 4:
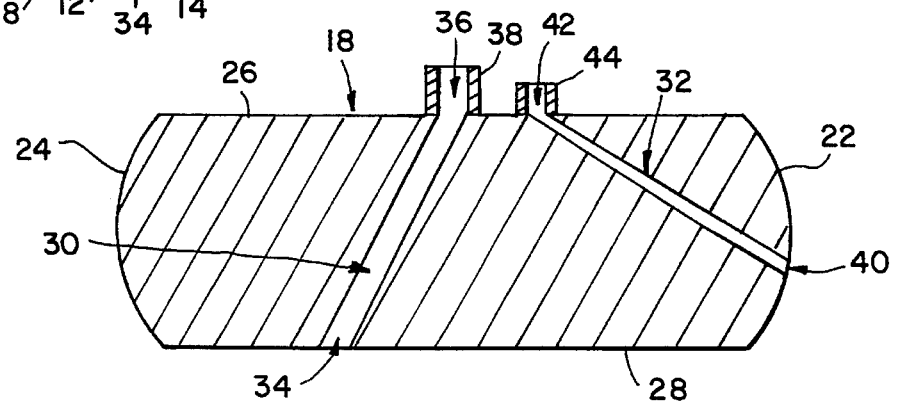
FIG. 4 is an enlarged cross-sectional side view of the sealant dispensing head of the sealant applicator apparatus of FIG. 1.

As can be best seen in FIGS. 2–4, the dispensing head 18 further comprises a sealant dispensing passage 30 and an air flow passage 32. The sealant dispensing passage 30 has a sealant outlet opening 34 at the convex bottom surface 28 positioned between the front end 22 and back end 24 of the dispensing head 18, and a sealant inlet opening 36 at the top side 26 of the dispensing head 18. As shown, the sealant inlet opening 36 is located midway between the front end 22 and back end 24 of the dispensing head 18 and is slanted from the inlet opening 36 in a direction back toward the back end 24 of the dispensing head 18. A threaded nipple 38 is mounted to the top side 26 of the dispensing head 18 concentric with the inlet opening 36 of the sealant dispensing passage 30. The air flow passage 32 has an outlet opening 40 located at the front end 22 of the dispensing head 18 (preferably at vertical centerline of the front end 22) and an air inlet end 42 located at the top side 26 of the dispensing head 18 adjacent the sealant inlet opening 36 of the sealant passage 30. An air hose attachment fitting 44 is attached to the top side 26 of the dispensing head 18 concentric with the air inlet opening 42.

As shown, the handle 20 is hollow, and defines a sealant supply flow passage 46 from the top or distal end 48 of the handle 20 to the bottom or proximal end 50 of the handle 20. The bottom or proximal handle end 50 has an internally threaded fitting 52 which threadably receives the threaded nipple 38 at the sealant inlet opening 36 for attaching the handle 20 to the dispensing head 18 and establishing a sealant flow through connection between the sealant supply flow passage 46 in the handle 20 and the sealant dispensing passage 30 in the dispensing head 18. A sealant hose connection fitting 54 is mounted at the top or distal end 48 of the handle 20 providing for the connection of a sealant supply hose (not shown) from a source of sealant (not shown). A sealant flow control valve 56 is located proximate the top or distal end 48 of the handle 20 allowing an operator to selectively control the flow of sealant through the sealant supply flow passage 46 of the handle 20 to and through the sealant dispensing passage 30 of the dispensing head 18.

As shown, an air supply hose 58 extends along the length of the handle and has its bottom outlet end attached to the air hose attachment fitting 44 of the dispensing head 18 and has a supply hose connection fitting 60 at its top inlet end. A supply hose (not shown) from a source of high pressure air (not shown) is connected to the connection fitting 60. An air flow control valve 62 is mounted in the air supply hose 58 allowing an operator to selectively control the flow of air through the air supply hose 58 to and through the air passage 32 of the dispensing head 18.

With reference to FIG. 7, there is shown a somewhat modified embodiment of the dispensing head 18. For the sake of brevity, the common features between the embodiments of FIGS. 1–4 and FIG. 7 will not be repeated and are denoted by identical numerals in the figures. While in FIGS. 1–4 the air passage 32 is formed through the dispensing head 18, in FIG. 5 the air passage 132 is formed at the exterior of the dispensing head 18. Toward this objectives the air passage 132 is formed of a conduit extending along a portion of the top side 26 of the dispensing head 18 and then downwardly over a portion of the front end 22 of the dispensing head 18. A portion of the length of the conduit defining the air passage 132 adjacent the air outlet end 40 is bent outwardly from and downwardly at the front end 22 of the dispensing head 18 at the vertical centerline of the front end 22.

With reference to FIGS. 8 and 9, there is shown another embodiment of the dispensing head, generally denoted as the numeral 218 to distinguish it from the dispensing head 18. The dispensing head 218 shares many identical features with the dispensing head 18, and for the sake of brevity these common features are identified in the drawings by identical numerals and the description thereof will not be repeated. As shown, the dispensing head 218 comprises a first sealant dispensing passage 30 extending through the dispensing head 18 slanted at an angle from the top side 26 generally toward the back end 24 of the dispensing head, and a second sealant dispensing passage 230 extending through the dispensing head 18 slanted at an angle from the top side 26 generally toward the front end 22 of the dispensing head. The first and second sealant dispensing passages 30 and 230, respectively, are symmetrically disposed to opposite sides of the imaginary vertical centerline (denoted by the letter "A") between the front end 22 and back end 24 of the dispensing head 18. The inlet opening 36 of the first sealant passage 30 is located at the top side 26 offset from the vertical centerline "A" toward the back end 24 of the dispensing head 18 and the inlet opening the inlet opening 236 of the second sealant passage 230 is located in the top side 26 and is symmetrically off set from the opposite side of the vertical centerline "A", i.e., toward the front end 22 of the dispensing head 18. That is, the amount of offset of the inlet opening 36 at the top side 26 to one side of the vertical centerline "A" is equal to the amount of offset of the inlet opening 236 at the top side 26 to the opposite side of the vertical centerline "A". The outlet opening 34 of the first sealant passage 30 is located at the bottom surface 28 offset from the vertical centerline "A" toward the back end 24 of the dispensing head 18 and the outlet opening 234 of the second passage 230 is located at the bottom surface 28 symmetrically offset from the opposite side of the vertical centerline "A", i.e., toward the front end 22 of the dispensing head 18. That is, the amount of offset of the outlet opening 34 to one side of the vertical centerline "A" is equal to the amount of offset of the outlet opening 234 to the opposite side of the vertical centerline "A". The dispensing head 18 further comprises a first air passage 32 extending through the dispensing head 18 slanted at an angle from the topside 26 to the front end 22 of the dispensing head, and a second air passage 232 extending through the dispensing head 18 slanted at an angle from the top side 26 to the back end 24 of the dispensing head 18. The first and second air passages 32 and 232, respectively, are symmetrically disposed to opposite sides of the imaginary vertical centerline "A". The air outlet opening 40 is located at the front end 22 and the inlet opening 42 of the first air passage 32 is offset from the vertical centerline "A" toward the back end 24 of the dispensing head 18. The air outlet opening 242 is located at the back end 24 and the inlet opening 242 of the second air passage 232 symmetrically is offset to the inlet opening 42 from the vertical centerline "A" toward the front end 22 of the dispensing head 18. That is, the amount of offset of the air inlet opening 42 to one side of the vertical centerline "A" is equal to the amount of offset of the air inlet opening 242 to the opposite side of the vertical centerline "A". The dispensing head 18 further comprises swivel coupling 264 for interconnecting the proximal end 50 of the handle 20 to the top side 26 of the dispensing head 18. The swivel coupling 264 is disposed with its rotational axis coaxial to the vertical centerline "A" of the dispensing head 18. The swivel coupling is formed with a sealant flow-through aperture 266 offset from the rotational axis by a distance equal to the offset of the sealant inlet openings 36 and 236 of the sealant dispensing passages 30 and 230 from the vertical centerline "A". Similarly, the swivel coupling is formed with an air flow-through aperture 268 offset from the rotational axis by a distance equal to the offset of the air inlet openings 42 and 242 of the air passages 32 and 232 from the vertical centerline "A". In use, the swivel coupling 264 allows the handle 20 to swivel in a horizontal plane through an angle of at least 180 degrees so that the workman using the applicator device 10 to push the dispenser head 18 is one direction along a groove 14 to be filled with a sealant and upon reaching the end of the groove 14 to merely swivel the handle 20 about the swivel coupling axis thereby allowing the workman to push the dispenser head 18 along the groove in the opposite direction without having to lift the applicator apparatus to reposition the dispensing head.

Now with reference to FIGS. 10 and 11, there is shown a portion of the applicator apparatus 10 in partial cross-section to show internal details of an alternative universal coupling, denoted as the numeral 364 to distinguish it from the coupling 264, and a stop device 370 to limit the movement of the handle 20 in the vertical plane. The universal coupling 364 comprises a hollow ball 372 affixed to the distal end 50 of the handle 20 open to the hollow interior of the handle 20 defining the sealant supply flow passage 46, and a socket fitting 374 formed in the top side 26 of the dispensing head 318 receiving the ball 372. The socket fitting 374 is open to the sealant inlet opening of the sealant dispensing passage 30 and the sealant inlet opening of the dispensing passage 230 through the dispensing head 18. The universal coupling 364 allows the handle 20 to be moved in a vertical plane to allow the workman to adjust the angle of the handle 20 to suit the height of the workman, and to also pivot the handle 20 in a horizontal plane so that the workman can reverse the direction in which he pushes the dispenser head 318 without having to lift the applicator apparatus 10. When the handle 20, and therfore also the ball 372, is rotated in a horizontal plane the ball 372 is in open communication with only one or the other of the sealant dispensing passages 30, 230. The stop device 370 is provided to secure the handle 20 at the selected vertical angle. As shown, the stop device 370 is attached to the handle 20 and abuts the top side 26 of the dispensing head 318. The stop device 370 is illustrated as comprising a depending stem 376 attached at its top or proximal end to the handle 20. An elongated abutment flange 378 is horizontally disposed and attached to the bottom or distal end of the depending stem 376 to abut the top side 26 of the dispensing head 318 regardless of the rotated position of the handle 20 in the horizontal plane. The top or proximal end of the stem 376 is threaded and is received in an appropriately thread bore in an attachment fitting 380 mounted to the handle 20. By threading the stem 376 into and out of the threaded bore in the attachment fitting 380 the length of the stem 376 depending from the handle 20 can be selected to prevent the handle 20 from pivoting downwardly in the vertical plane beyond the selected angle.

Figure 12:
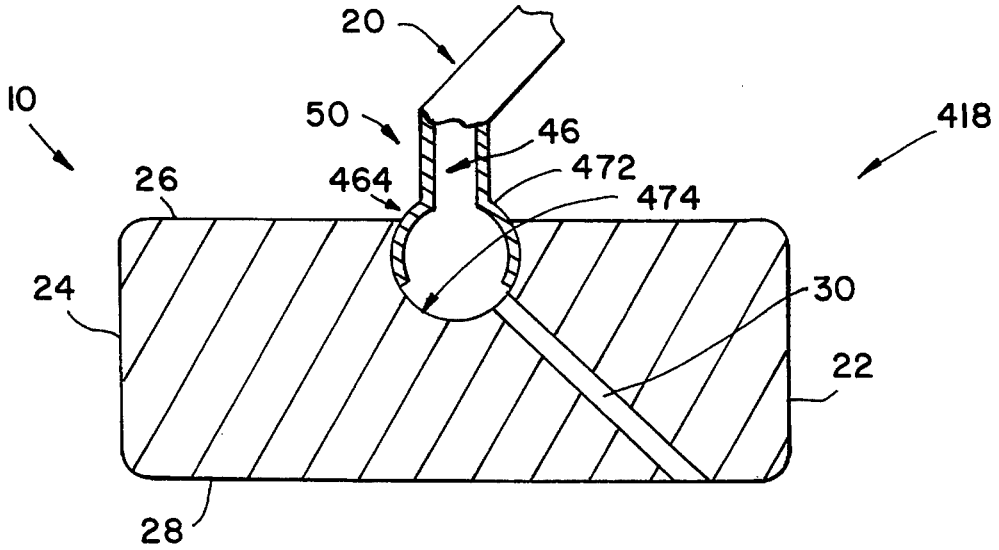

With reference to FIG. 12, there is shown a portion of the applicator apparatus 10 in partial cross-section to show internal details of another alternative universal coupling, denoted as the numeral 464 to distinguish it from the coupling 364. The universal coupling 464 comprises a hollow ball 472 affixed to the distal end 50 of the handle 20 open to the hollow interior of the handle 20 defining the sealant supply flow passage 46, and a socket fitting 474 in the top side of the dispensing head 418 receiving the ball 472. The dispensing head 418 has a single sealant dispensing passage 30 and the socket fitting 474 is open to the sealant inlet opening of the sealant dispensing passage 30 regardless of the rotational orientation of the hollow ball 472 in the socket fitting 474. The universal coupling 464 allows the handle 20 to be pivoted in a horizontal plane so that the workman can reverse the direction in which he can push the dispenser head 418 without having to lift the applicator apparatus 10. When the handle 20, and therefore also the ball 472 is rotated in a horizontal plane the ball 472 remains in open communication with the single sealant dispensing passage 30.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. An applicator apparatus for dispensing and shaping a sealant material into a groove to be filled with the sealant material comprising:

a. a dispensing head having a front end, a back end, a top side and a convex bottom surface for shaping the sealant material deposited in the groove as the dispensing head is moved along the length of the groove, and the convex bottom surface having a width dimension greater than the width of the groove so that when in use the dispensing head remains in contact with the opposite side edges of the groove and so that a portion of the convex surface protrudes into the groove for shaping the upper surface of the sealant material deposited in the groove;

b. a sealant dispensing passage having a sealant outlet opening at the bottom surface of the dispensing head, and a sealant inlet opening located in the top side of the dispensing head; and, c. an air passage having an air outlet opening located in the bottom surface of the dispensing head between the sealant outlet opening of the sealant dispensing passage and the front end of the dispensing head.

2. The applicator apparatus of claim 1, wherein the sealant dispensing passage is formed through the dispensing head.

3. The applicator apparatus of claim 2, wherein the sealant flow passage is slanted in a direction generally from the front end toward the back end of the dispensing head.

4. The sealant applicator apparatus of claim 2, further comprising air flow means for connecting the air passage to a source of air, and air flow control means associated with the air flow means for controlling the flow of air through the air passage.

5. The applicator apparatus of claim 1, wherein the sealant flow passage has a sealant inlet end at the top side of the dispensing head.

6. The sealant applicator apparatus of claim 1, further comprising sealant flow means for connecting the sealant dispensing passage to a source of sealant to be dispensed, and sealant flow control means associated with the sealant flow means for controlling the flow of sealant through the sealant dispensing passage.

7. The sealant applicator apparatus of claim 1, further comprising a handle attached to the top side of the dispensing head providing for the manual movement of the dispensing head along the length of the groove.

8. The sealant applicator apparatus of claim 7, further comprising sealant flow means inside the handle for connecting the sealant dispensing passage in the dispensing head to a source of sealant.

9. The sealant applicator apparatus of claim 8, wherein the sealant flow means comprises the handle having a hollow interior with the bottom end of the hollow interior being in sealant flow communication with the sealant the sealant dispensing passage.

* * * * *